United States Patent [19]

Schuller et al.

[11] 3,939,952

[45] Feb. 24, 1976

[54] CONTROL FOR A VENDOR INCLUDING CARD RETENTION MEANS

[75] Inventors: James T. Schuller, St. Louis County; Anton Okolischan, Crestwood, both of Mo.

[73] Assignee: UMC Industries, Inc., New York, N.Y.

[22] Filed: Oct. 30, 1974

[21] Appl. No.: 519,114

[52] U.S. Cl. ..... 194/4 C; 194/98

[51] Int. Cl.[2] ..... G07F 7/08

[58] Field of Search ..... 194/4 R, 98, DIG. 15

[56] References Cited

UNITED STATES PATENTS

| | | | |
|---|---|---|---|
| 675,212 | 5/1901 | Handy | 194/98 |
| 1,714,631 | 5/1929 | Rowe | 194/98 X |
| 2,361,363 | 10/1944 | Baur | 194/98 |
| 2,491,900 | 12/1949 | Mihalek | 174/98 X |

*Primary Examiner*—Stanley H. Tollberg
*Attorney, Agent, or Firm*—Koenig, Senniger, Powers and Leavitt

[57] ABSTRACT

A control for a vendor operable by a coded card comprising a validator for validating the code on the card inserted by a customer, enabling a vend if the card is valid, rejecting the card if invalid, and feeding the card out of the validator upon completion of a vend. A validated card fed out of the validator upon a vend is releasably retained for verification of the insertion of a proper card by the customer, being held for verification until the subsequent vend, and then released to storage.

4 Claims, 5 Drawing Figures

CONTROL FOR A VENDOR INCLUDING CARD RETENTION MEANS

BACKGROUND OF THE INVENTION

This invention relates to a control for a vendor, and more particularly to a control for a vendor having means for retaining a card for verification of the insertion of a proper card by a customer.

The invention is especially concerned with control for a coded-card-operated vendor such as is coming into use in supermarkets for vending merchandise such as cartons of cigarettes instead of openshelf display. The usual sequence of operation of such a vendor is to receive a coded card inserted by a customer, validate the card, and then return the card to the customer if invalid, or if valid, enable a vend of the selected merchandise while transferring the card to storage where it is intermingled with previously inserted cards.

With respect to coin-operated vendors for relatively inexpensive merchandise such as candy, gum, or single packages of cigarettes, when a customer complains he inserted his money but received no merchandise, the store management may either return the customer's money or give him the merchandise without question. With respect to vending of relatively expensive items such as cartons of cigarettes via coded cards, however, such practice may be wholly uneconomical. Accordingly, there is the problem of verifying the genuineness of a complaint by a customer.

SUMMARY OF THE INVENTION

Among the several objects of this invention may be noted the provision of a control for a coded-card-operated vendor which enables verification, on complaint of a customer that he has inserted a proper card but has not received his merchandise, that he has actually inserted a proper card; and the provision of such a control which is reliable in operation, adapted to handle cards without jamming, and relatively economical to incorporate in a vendor.

Briefly, a control of this invention for a coded-card-operated vendor comprises a validator for receiving a card inserted by a customer, and means for receiving a validated card from the validator. The validator functions to validate the card, to enable a vend if the card is valid, to reject the card if invalid, and to feed the card out of the validator on a vend. The means for receiving a validated card receives the card as it is fed out of the validator and releasably retains it for verification of the insertion of a proper card by the customer. Means operable upon a vend operates the receiving means to release a previously received card to storage.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
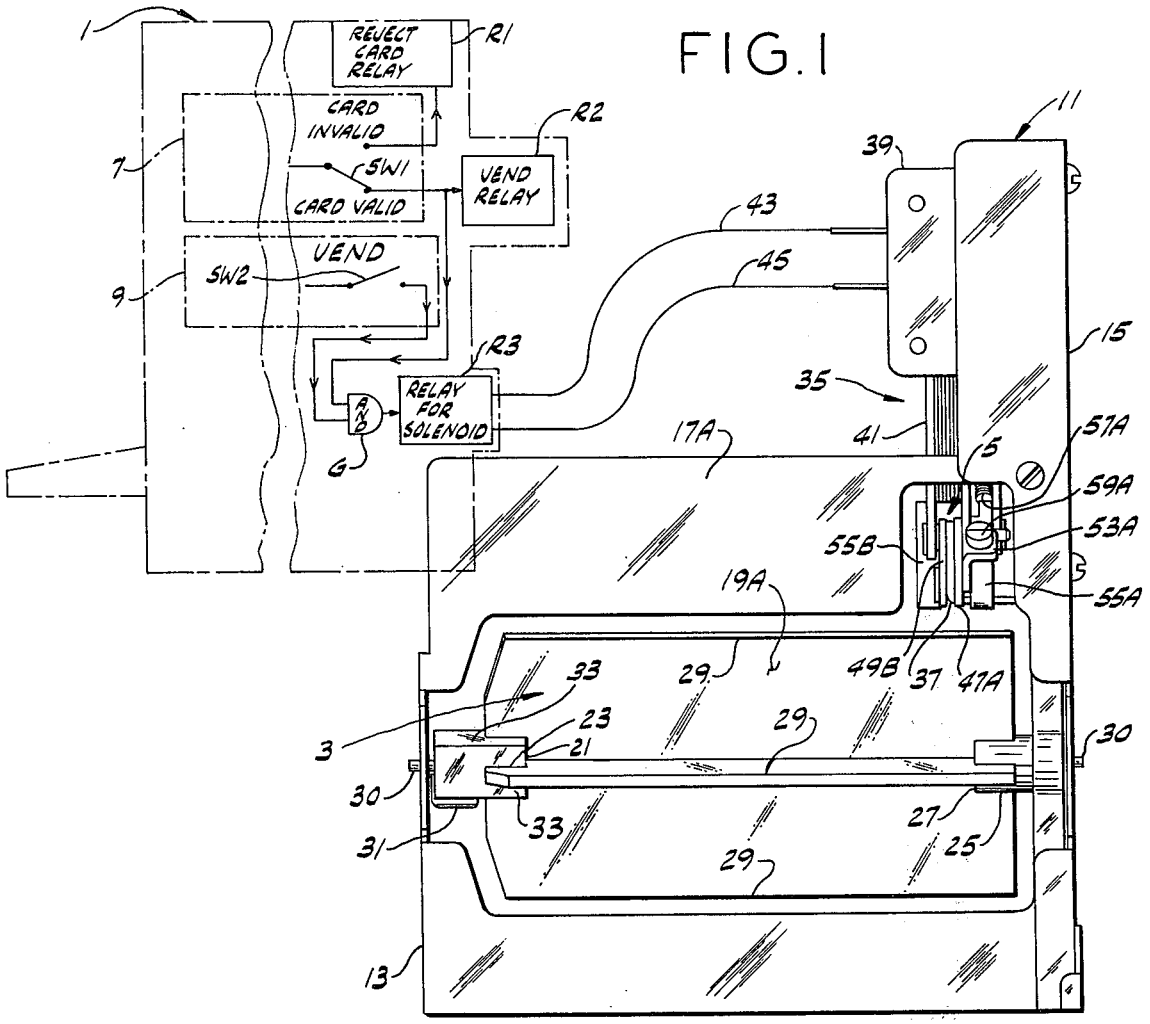
FIG. 1 is a view in side elevation of a control of this invention, showing the relative positions of the validator and receiving means of the control, and including a logic diagram.
Figure 2:
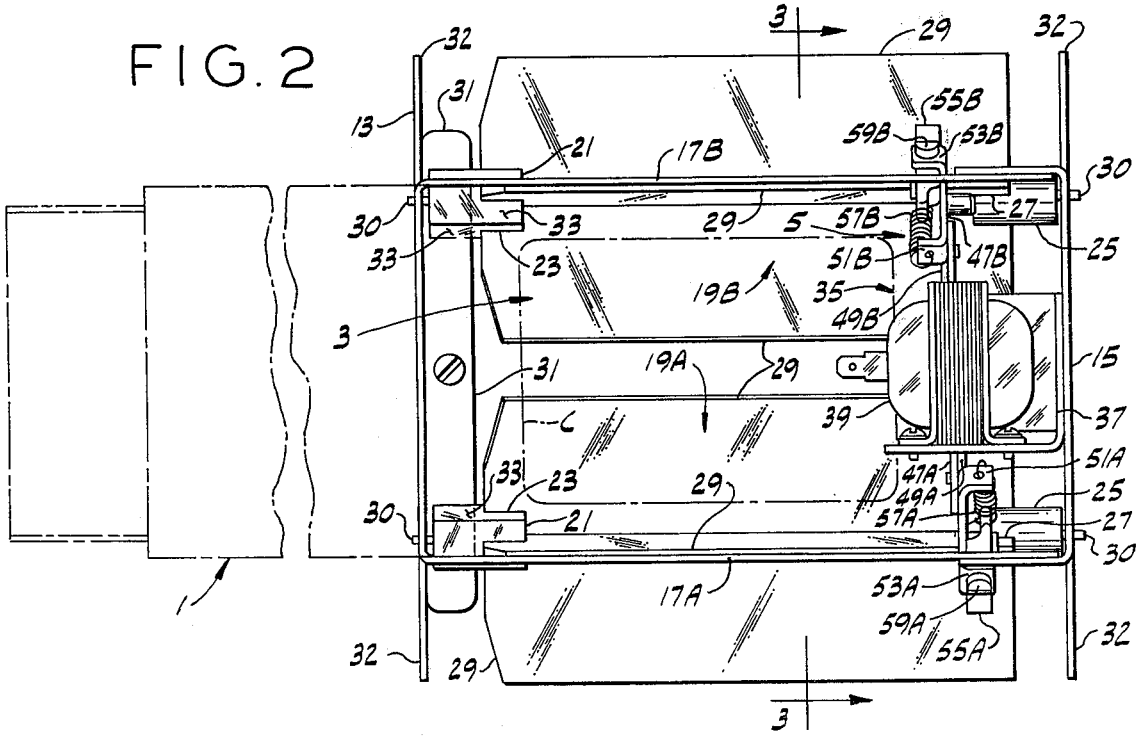
FIG. 2 is a plan of the control showing the relative positions of the validator and receiving means.

Referring to FIGS. 1 and 2, a control of this invention for a coded-card-operated vendor is shown generally to comprise a validator 1, means for receiving a card from the validator 3, and means 5 for operating the receiving means. The validator is a commercially available item, such as supplied by National Rejectors Industries of Hot Springs, Arkansas, adapted to receive at one end thereof (its left end as shown in FIG. 1) a magnetic-stripe-coded card C inserted in horizontal position by a customer, validate the card, reject the card if invalid (return it back to the customer at said one end of the validator) and enable a vend if the card is valid while at the same time feeding the card out in horizontal position out of the validator at its other end out to the receiving means. As will appear, it also functions to cause activation of the receiving means 3 on each vend.

As diagrammatically shown in FIG. 1, a validator circuit 7 includes a double-throw switch SW1, the upper contact of which is connected to a relay R1 which is adapted upon energization to cause rejection, i.e., return, of the previously inserted card to the customer. The lower contact of switch SW1 is commonly connected to one input of an AND gate G and to a relay R2 which is adapted upon energization to cause both a vend operation and transfer of the card to the receiving means 3. Circuit 7 operates via the code on the card inserted by the customer to validate the card and, if the card is invalid, to cause switch SW1 to energize relay R1 or, if the card is valid, to cause the switch to energize relay R2 and enable gate G. The power supply to circuit 7, as well as other circuitry in the validator, is not shown in order to simplify the drawing.

The validator also has a circuit 9 diagrammatically illustrated as including a switch SW2 the output of which is connected to an input of gate G. Circuit 9 is adapted to close switch SW2 thereby providing a signal to gate G upon a vend. For example, switch SW2 may be constituted by a set of contacts of a switch which is actuated by a customer to effect a vend after he has inserted a valid card and the vend relay R2 has been energized. A relay R3 connected to the output of gate G is adapted upon energization to in turn energize the means 5 for operating the receiving means. Both the receiving means 3 and means 5 for operating the receiving means are mounted on a support structure 11 having a front 13, a back 15 and sides 17A and 17B.

The means 3 for receiving the validated card from the validator upon a vend releasably retains the card for verification of the insertion of a proper card by the customer. Means 3 comprises a movable series of card supporting means comprising a pair of identical wheels 19A and 19B with the axis of each wheel in a horizontal plane, each wheel being supported between the front 13 and the back 15 of supporting structure 11.

Each wheel comprises a front end hub 21 having a set of equally spaced slots 23, a back end hub 25 having a matching set of equally spaced slots 27, and a plurality of radially extending vanes or blades 29 held in the slots in the hubs. Four vanes spaced at 90° intervals are shown. The front hub and the back hub of each wheel are journalled in the front and back respectively of the supporting structure by trunnions 30. The front hubs are of square cross section having four flat sides 33, each of the four flats 33 corresponding to a vane of the wheel. A leaf spring 31 (e.g., a length of spring steel) attached to the front of the supporting structure engages the front hub of each wheel at the bottom and acts to restrain free rotation of the wheels and to tend to hold the wheels in a rest position wherein a flat 33 of the hub is fully in contact with the spring with one vane of each wheel extending generally horizontally toward the axis of the other wheel (and toward the center of the supporting structure). Thus, the spring tends to bias the wheels so that a generally horizontal card supporting surface is formed by one vane of each wheel in rest position. Accordingly, as a card is fed out of the validator it is held in a generally horizontal position, it being understood that the validator is positioned above the wheels so that as the card is fed out of the validator, it falls onto the supporting surface formed by the two opposed vanes of the wheels. The sides of the supporting structure have cut-out sections through which the wheels extend and the front and back of the supporting structure have extensions 32 which form shrouds or shields for the wheels.

Figure 3:
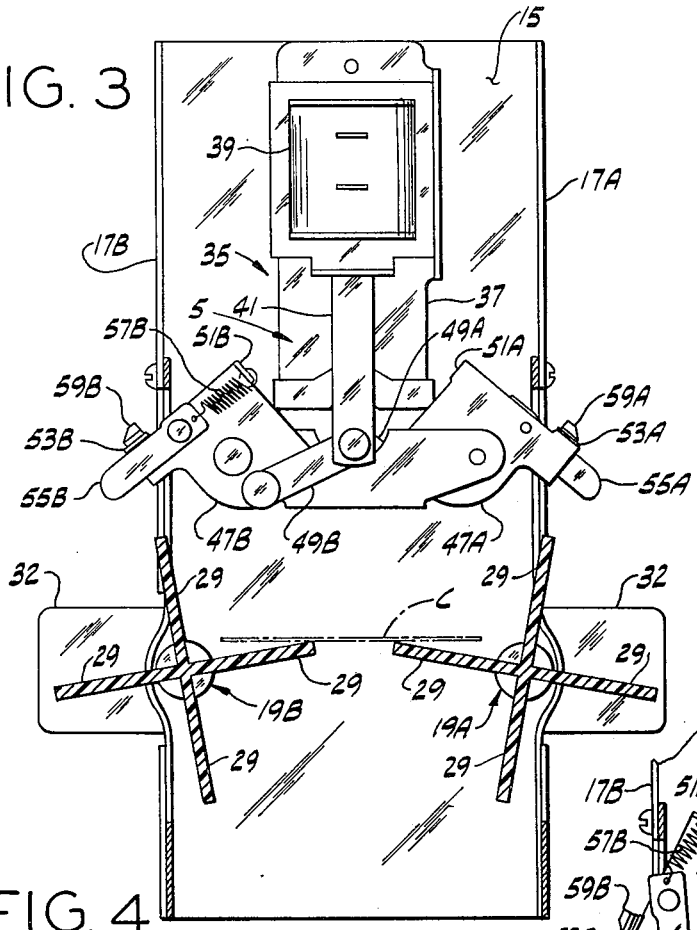
FIG. 3 is a vertical section on line 3—3 of FIG. 2, showing the rest position of certain actuating means.
Figure 5:
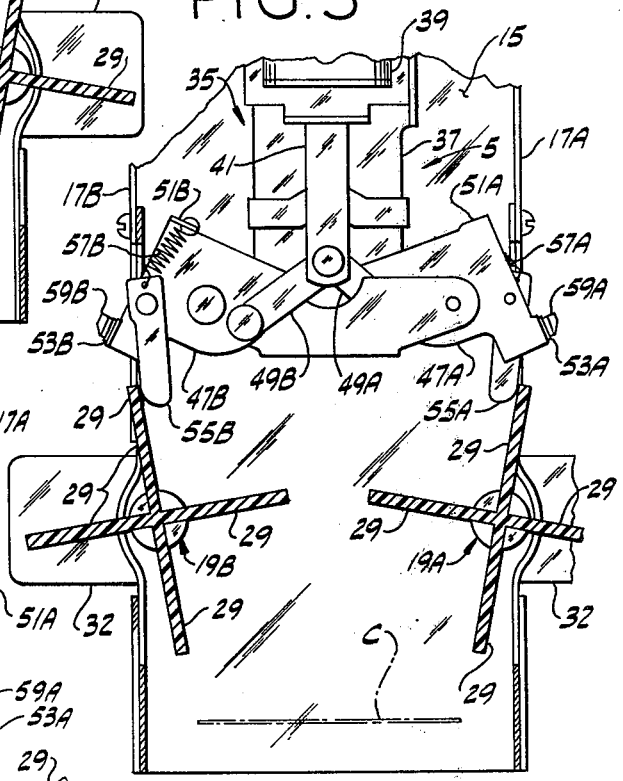
FIGS. 4 and 5 are views similar to FIG. 3 showing moved positions of parts.
Figure 4:
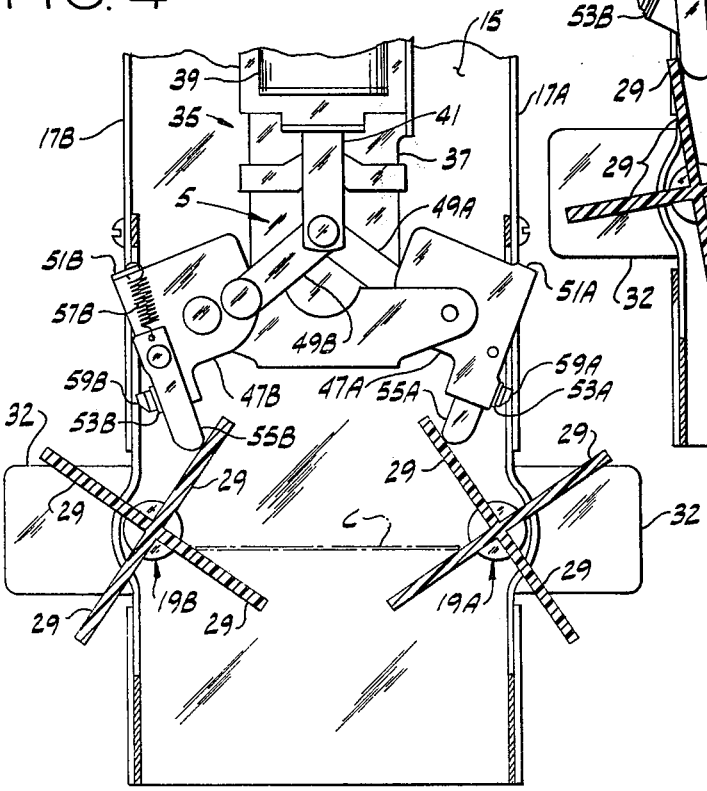

The means 5 for operating the receiving means is best shown in FIGS. 3–5 and comprises means 35 for actuating the receiving means and means responsive to the validator for activating the actuation means, both of which are mounted on a bracket 37 attached to the back of the supporting structure. The activator means comprises a solenoid 39 having an armature 41 which is adapted for vertical movement when the solenoid is energized. The connection end of armature 41 is bifurcated. The input terminals of the solenoid are connected to contacts (not shown) of relay R3 via leads 43 and 45 so that when R3 is energized, power is supplied energizing the solenoid.

The means for actuating wheels 19A and 19B further comprises a pair of levers 47A and 47B pivotally mounted on a front extension of the bracket 37. Lever 47A is mounted generally above wheel 19A on the right side of and behind the front extension of the bracket, lever 47B being mounted on the left side of and in front of the extension, generally above wheel 19B. The levers 47A and 47B are connected to the bifurcated end of armature 41 by links 49A and 49B, respectively, so that when solenoid 39 is energized to lift armature 41, lever 47A will be rotated clockwise and lever 47B counterclockwise as viewed in FIGS. 3–5.

Levers 47A and 47B have bent-over tabs at their top, 51A and 51B respectively, and at the lower portion of their outer sides, 53A and 53B respectively. A pair of fingers or pawls 55A and 55B pivotally mounted on levers 47A and 47B, respectively, are biased by springs 57A and 57B which are connected between the tops of the fingers and tabs 51A and 51B to retracted positions wherein the respective fingers contact tabs 53A and 53B respectively. Fingers 55A and 55B extend below the levers and are adapted to contact the uppermost vanes of wheels 17A and 17B respectively thereby causing rotation of wheel 17A in a counterclockwise direction and wheel 17B in a clockwise direction. Thus, when the solenoid is energized, wheels 17A and 17B are rotated in opposite directions.

Mounted on each of tabs or stops 53A and 53B for the fingers or pawls 55A and 55B is a stud, 59A and 59B, respectively. Each stud serves to limit the forward rotation of the respective wheel. Thus, if a wheel should tend to spin forward, a vane of the wheel will engage the stud to stop the wheel. Also, if a wheel has slightly overtraveled so that a flat 33 of its front hub is not fully in contact with the spring 31, the stud will push the wheel back to its proper rest position when the solenoid has been deenergized.

As to the operation of the control, it may be assumed that there is a card C from the previous cycle of operation on the inwardly extending generally horizontal vane of wheel 19A and the inwardly extending generally horizontal vane of wheel 19B as appears in FIG. 3. When a customer then inserts a card C in the validator 1, the validator functions to validate or invalidate the card. Assuming the card to be valid, the validator causes switch SW1 to be switched to its valid position to energize the vend relay R2 to enable a vend and to activate the gate G. With the vend relay R2 energized, the customer may make his selection and effect a vend of the selected item. Switch SW2 closes momentarily upon the vend, and, via gate G, energizes relay R3 causing energization of solenoid 39 to actuate means 35 for actuating the wheels 19A and 19B.

Actuation of wheels 19A and 19B occurs via armature 41 of solenoid 39 being raised, with resultant swinging of levers 47A and 47B to cause the fingers or pawls 55A and 55B on these levers to contact the upwardly extending vanes of the wheels, whereby the wheels rotate in opposite directions for release of the card C which was on the inwardly extending vanes. As appears in FIGS. 4 and 5, wheel 19A rotates counterclockwise and wheel 19B rotates clockwise, and the two vanes which supported the card move down and away under the card to enable it to drop out to storage. The next two vanes swing down and in to the rest position to receive the card fed out of the validator on the vend. These two vanes swing inwardly from their FIG. 3 position in ample time to receive the card discharged from the validator.

Thus, the card receiver 3 functions to release to storage the card C which was in the receiver as a result of the previous vend and, at the same time, to receive the card discharged from the validator upon the instant vend. It retains the latter card for inspection by management personnel until the next vend. Thus, if any question concerning the propriety of the card arises, it can be easily identified since it has not been released to storage (below the receiver 3) where it would become intermingled with previously inserted cards.

When switch S2 opens after its momentary closure on a vend, solenoid 39 is deenergized and armature 41 drops, resulting in return of the levers 47A and 47B to their FIG. 3 position. If the wheels have overtraveled so that they are not in a proper biased position, on the return of the levers the studs 59A and 59B will push the uppermost vanes of the wheels to their proper position. However, assuming that the wheels have come to rest in their proper positions, actuating means 35 will return to its rest position without any actuation of the wheels, pawls 55A and 55B swinging on their pivots against the bias of springs 57A and 57B to clear the vanes.

The provision of the vaned wheel arrangement for holding the card is advantageous in that it reliably enables release of a card therefrom to storage and acceptance of a card from the validator on a vend. Even though a card is relatively light in weight, the release is positive. This is in contrast to a "trap-door" arrangement, for example, in which a trap door is swung down to release the card and then back up, and wherein the card might not fall clear of the door before it came back up.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A control for a vendor operable by a coded card comprising:

a validator in which a customer inserts a card at one end thereof with the card in horizontal position, said validator being operable to validate the card, to enable a vend if the card is valid, to reject the card back to the customer at said one end if the card is invalid, and to feed the card in horizontal position out of the validator at its other end on a vend;

means adjacent the other end of the validator for receiving a validated card in horizontal position from the validator as it is fed out of the validator upon a vend and releasably retaining it in horizontal position for verification of the insertion of a proper card by the customer; and means operable upon a vend for operating said receiving means to release a previously received card to storage.

2. A control as set forth in claim 1 wherein said receiving means comprises a series of individual card-supporting means one of which occupies a card-holding position for receiving and retaining in horizontal position a card fed out of the validator, and means mounting said series for movement to move said one supporting means away from said card-holding position for release to storage of the retained card and movement to the card-holding position of the next card-supporting means in the series, each supporting means moving out from under the card in moving away from said card-holding position, said operating means acting to move said series through a step upon a vend for release of a retained card and for receiving the next validated card from the validator.

3. A control for a vendor operable by a coded card comprising a validator in which a customer inserts a card, said validator being operable to validate the card, to enable a vend if the card is valid, to reject the card if invalid, and to feed the card out of the validator on a vend, means for receiving a validated card from the validator as it is fed out of the validator upon a vend and releasably retaining it for verification of the insertion of a proper card by the customer, means operable upon a vend for operating said receiving means to release a previously received card to storage, said receiving means comprising a series of individual card-supporting means one of which occupies a card-holding position for receiving and retaining a card fed out of the validator, and means mounting said series for movement to move said one supporting means away from said card-holding position for release to storage of the retained card and movement to the card-holding position of the next card-supporting means in the series, said operating means acting to move said series through a step upon a vend for release of a retained card and for receiving the next validated card from the validator, each supporting means in said card-holding position holding the card in generally horizontal position and moving out from under the card in moving away from card-holding position, said receiving means comprising a pair of wheels each having generally radial vanes, said wheels being mounted for rotation one alongside the other with their axes generally horizontal and parallel to one another, and being rotatable in steps to bring a vane of each wheel into a generally horizontal card-supporting position extending from the axis of the wheel toward the axis of the other wheel, said operating means acting to rotate said wheels in opposite directions in steps corresponding to the spacing of the vanes.

4. A control as set forth in claim 3 wherein said operating means comprises a solenoid adapted for actuation in response to a vend and means operated by the solenoid for rotating said wheels in opposite directions through a step.

* * * * *